US007156018B2

(12) United States Patent
Holm et al.

(10) Patent No.: US 7,156,018 B2
(45) Date of Patent: Jan. 2, 2007

(54) PRINTING COUPLE IN A PRINTING MACHINE WITH A PIVOTABLE TRANSFER CYLINDER

(75) Inventors: Helmut Holm, Erlabrunn (DE); Manfred Herrmann Liebler, Erlenbach (DE); Manfred Walter Wirth, Rieneck (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/473,148

(22) PCT Filed: Apr. 6, 2002

(86) PCT No.: PCT/DE02/01263

§ 371 (c)(1),
(2), (4) Date: Jan. 21, 2004

(87) PCT Pub. No.: WO02/081215

PCT Pub. Date: Oct. 17, 2002

(65) Prior Publication Data

US 2005/0034615 A1 Feb. 17, 2005

(30) Foreign Application Priority Data

Apr. 9, 2001 (DE) ..... 101 17 703
Aug. 3, 2001 (DE) ..... 101 38 221

(51) Int. Cl.
*B41F 13/24* (2006.01)

(52) U.S. Cl. ..... 101/218; 101/247

(58) Field of Classification Search ..... 101/212, 101/216, 218, 217, 378, 142, 247
See application file for complete search history.

(56) References Cited

U.S. PATENT DOCUMENTS

| | | | | |
|---|---|---|---|---|
| 3,230,879 | A * | 1/1966 | Worthington | 101/378 |
| 3,552,313 | A * | 1/1971 | Jeschke | 101/218 |
| 3,611,924 | A * | 10/1971 | Harrison | 101/98 |
| 4,125,073 | A | 11/1978 | Bain | |
| 4,233,898 | A | 11/1980 | Dahlgren | |
| 4,411,194 | A * | 10/1983 | Davidson, Jr. | 101/216 |
| 4,598,640 | A | 7/1986 | Nawrath | |
| 5,005,475 | A | 4/1991 | Knauer | |
| 5,235,910 | A * | 8/1993 | Tafel | 101/218 |
| 5,265,529 | A * | 11/1993 | Tafel | 101/218 |

(Continued)

FOREIGN PATENT DOCUMENTS

| | | |
|---|---|---|
| CH | 345906 | 6/1960 |

(Continued)

*Primary Examiner*—Daniel J. Colilla
*Assistant Examiner*—Jill E. Culler
(74) *Attorney, Agent, or Firm*—Jones, Tullar & Cooper, PC

(57) ABSTRACT

A printing couple in a printing machine is comprised of at least three cylinders, a forme cylinder, a transfer cylinder and a counter-pressure cylinder. The counter-pressure cylinder forms a printing location or point in cooperation with the transfer cylinder. The transfer cylinder is mounted in at least one lever which can be pivoted about an eccentrically pivoting axis in relation to the rotational axis of the forme cylinder. When the three cylinders are in a print position, a connecting plane through the axis of rotation of the forme cylinder and the pivoting axis of the lever forms an angle of between 25° and 65° with a plane through the axis of rotation of the cylinder forming the printing point.

34 Claims, 10 Drawing Sheets

U.S. PATENT DOCUMENTS

| | | | | | |
|---|---|---|---|---|---|
| 5,272,975 | A | * | 12/1993 | Dettinger et al. | 101/218 |
| 5,301,609 | A | | 4/1994 | Guaraldi et al. | |
| 5,588,362 | A | * | 12/1996 | Sugiyama et al. | 101/218 |
| 5,649,482 | A | * | 7/1997 | Hummel et al. | 101/218 |
| 5,690,029 | A | * | 11/1997 | Herrmann et al. | 101/218 |
| 5,692,439 | A | | 12/1997 | Wech | |
| 5,697,296 | A | * | 12/1997 | Thunker et al. | 101/216 |
| 5,816,157 | A | | 10/1998 | Gertsch et al. | |
| 5,868,071 | A | | 2/1999 | Niemiro et al. | |
| 5,979,317 | A | * | 11/1999 | Singler | 101/218 |
| 6,019,039 | A | | 2/2000 | Knauer et al. | |
| 6,332,397 | B1 | * | 12/2001 | Bolza-Schunemann et al. | 101/183 |
| 6,334,389 | B1 | * | 1/2002 | Fischer | 101/216 |
| 6,374,731 | B1 | * | 4/2002 | Walczak et al. | 101/142 |
| 6,397,743 | B1 | | 6/2002 | Dauer et al. | |
| 6,408,747 | B1 | * | 6/2002 | Koppelkamm et al. | 101/147 |
| 6,435,092 | B1 | * | 8/2002 | Hillebrand | 101/483 |
| 6,494,138 | B1 | | 12/2002 | Gottling et al. | |
| 6,539,857 | B1 | | 4/2003 | Weschenfelder | |
| 6,732,650 | B1 | | 5/2004 | Rauh | |
| 6,782,816 | B1 | * | 8/2004 | Bolza-Schunemann | 101/217 |
| 6,834,585 | B1 | | 12/2004 | Hahn | |
| 2002/0178946 | A1 | | 12/2002 | Hahn | |

FOREIGN PATENT DOCUMENTS

| | | | |
|---|---|---|---|
| DE | 34 12 812 | C1 | 6/1985 |
| DE | 91 09 833.5 | U1 | 10/1991 |
| DE | 44 02 389 | A1 | 9/1994 |
| DE | 44 19 217 | A1 | 7/1995 |
| DE | 44 15 711 | A1 | 11/1995 |
| DE | 44 35 986 | A1 | 4/1996 |
| DE | 197 24 765 | | 6/1997 |
| DE | 196 03 663 | A1 | 8/1997 |
| DE | 198 15 294 | A1 | 10/1998 |
| DE | 198 03 809 | A1 | 8/1999 |
| DE | 199 37 796 | A1 | 2/2001 |
| DE | 199 61 574 | A1 | 7/2001 |
| EP | 0 741 013 | A2 | 11/1996 |
| EP | 0 862 999 | A2 | 9/1998 |
| EP | 1 075 945 | A1 | 2/2001 |
| FR | 1257397 | | 3/1961 |
| GB | 1096950 | | 12/1967 |
| GB | 2 293 794 | A | 4/1996 |
| GB | 2 309 668 | A | 8/1997 |
| JP | 51-24309 | | 2/1976 |
| JP | 55-39865 | | 7/1978 |
| JP | 57-107842 | | 7/1982 |
| JP | 5713561 | A | 8/1982 |
| JP | 60-225799 | | 11/1985 |
| JP | 62-144632 | | 9/1987 |
| JP | 2-196658 | | 8/1990 |
| JP | 2-245333 | | 10/1990 |
| JP | 6-278264 | | 10/1994 |
| JP | 10071694 | A | 3/1998 |
| WO | WO 00/06385 | | 7/1999 |
| WO | WO 01/45946 | A1 | 6/2001 |
| WO | WO 01/45947 | A1 | 6/2001 |
| WO | WO 01/83215 | A1 | 11/2001 |

* cited by examiner

PRINTING COUPLE IN A PRINTING MACHINE WITH A PIVOTABLE TRANSFER CYLINDER

CROSS-REFERENCE TO RELATED APPLICATIONS

This patent application is the U.S. national phase, under 35 USC 371, of PCT/DE02/01263, filed Apr. 6, 2002; published as WO 02/081215 A2 on Oct. 17, 2002, and claiming priority to DE 101 17 703.8 filed Apr. 9, 2001, and to DE 101 38 221.9 filed Aug. 3, 2001, the disclosures of which are specifically incorporated herein by reference.

FIELD OF THE INVENTION

The present invention is directed to a printing group of a printing press with a pivotable transfer cylinder. The pivotable transfer cylinder is supported by at least one pivotable lever which is supported eccentrically with respect to an axis of rotation of a forme cylinder with which the transfer cylinder cooperates.

BACKGROUND OF THE INVENTION

A printing group is known from DE 198 03 809 A1. A forme cylinder has one printing plate in the circumferential direction on its circumference, and several printing plates in the longitudinal direction. A transfer cylinder working together with the forme cylinder has double the circumference and is embodied for having one printing blanket in the circumferential direction and two in the longitudinal direction which two printing blankets, however, are arranged offset from each other in the circumferential direction.

JP 10-071 694 discloses printing group cylinders with four grooves arranged next to each other and offset in the circumferential direction in respect to each other. The printing group cylinders have a so-called double circumference.

An arrangement for a joint-free printing press is known from CH 345 906. The joints of four dressings which are arranged next to each other on transfer cylinders of double circumference, and the joints of four dressings which are arranged next to each other on a forme cylinder, are arranged offset from each other.

A double printing group is known from DE 198 15 294 A1, wherein the rotating shafts of the printing group cylinders are arranged on one level. The cylinders have four times the width of a newspaper page, double width, and a circumference of one height of a newspaper page. The transfer cylinders have endless sleeves, which can be laterally exchanged through openings in the lateral wall.

Printing group cylinders of single circumference are known from U.S. Pat. No. 4,125,073, which have an oscillation damper. In the case of wider printing presses, the forme cylinder has a double circumference and two printing plates arranged one behind the other. The grooves, which are arranged in the longitudinal direction next to each other and which receive the printing plates, are additionally offset in respect to each other in the circumferential direction.

A double printing group is known from DE 44 15 711 A1. For the purpose of improving the print quality, a plane which extends perpendicularly to the paper web is inclined by approximately 0° to 10° in relation to a plane connecting the two rotating shafts of the transfer cylinders.

JP 57-131 561 discloses a double printing group wherein the shafts of the printing group cylinders are arranged in one plane. The phases of the printing group cylinders are arranged with each other in such a way that grooves for fastening the dressings roll off on each other, and simultaneously on the two printing groups which are working together.

A double printing group is also disclosed in DE 34 12 812 C1. The cylinder shafts are arranged in a common plane, which extends inclined in relation to the web to be imprinted. The placement of the transfer cylinders against, or away from other cylinders takes place along an almost straight movement direction by the use of double eccentric cams.

EP 0 862 999 A2 discloses a double printing group with two transfer cylinders which are working together and which are seated in eccentric, or double eccentric bushings, for the purpose of being placed against or away from other cylinders. In another embodiment, the two transfer cylinders are seated on levers, which are seated eccentrically in respect to the forme cylinder shaft and are pivotable.

A device for engaging or for disengaging a transfer cylinder of a printing unit with cylinders, which are arranged at angles with respect to each other, is known from DE 44 35 986 A1. The transfer cylinder, which is seated in a lever around the forme cylinder, is initially placed against the forme cylinder by a first setting device via an eccentric device, and subsequently is placed against the counter-pressure cylinder by a second setting device acting on the lever. For adjusting purposes, the lever is eccentrically seated on the journal of the forme cylinder.

A printing press, with bridge-shaped printing units, is known from EP 0 741 013 A2. The transfer cylinders, seated in levers, are pivotable around the axis of rotation of the associated forme cylinder for forming an accessible spacing.

DE 44 02 389 A1 discloses cylinders for printing group which are located on one level. The transfer cylinders are seated in pivotable levers. The disengagement of the cylinders from each other takes place by pivoting the forme cylinders. One of the transfer cylinders is disengaged from the cooperating transfer cylinder because of the pivoting away of the forme cylinder and because of gravity.

SUMMARY OF THE INVENTION

The object of the present invention is directed to providing a printing group of a printing press with a pivotable transfer cylinder.

In accordance with the present invention, this object is attained by the provision of a printing group having at least three cylinders, a forme cylinder, a transfer cylinder and a counter-pressure cylinder. The transfer cylinder and the counter-pressure cylinder form a printing position. The transfer cylinder is seated in at least one pivotable lever that is supported eccentrically with respect to an axis of rotation of the forme cylinder. In a print position, a connecting plane through the axis of rotation of the forme cylinder and the lever pivot axis defines an angle, with respect to a plane through the axes of the transfer cylinder and the counter-pressure cylinder of between 25° and 65°. In one configuration, the axes of the three cylinders lie in a common plane in a print-on position. The axis of rotation of the forme cylinder is fixed. The pivotable transfer cylinder can be moved into or out of engagement with the two other cylinders by pivoting the lever.

The advantages which can be gained by the present invention lie, in particular, in that a printing press is provided which is constructed in a compact, low-oscillating and rugged manner, provides a large production variety and requires a comparatively low production and maintenance outlay.

Minimizing the number of parts which must be designed to be movable for normal operations and during setup, for example omitting the movement of all cylinders, frame walls, bearings etc., assures a rugged and cost-effective construction.

The cylinders support each other by the linear arrangement of the printing group cylinders, i.e. by the arrangement of the rotating shafts of the printing group cylinders in the print-on position in substantially one plane. This prevents relative sagging of the cylinders. Even a compensation of the bending static line of the forme and of the transfer cylinders, in respect to each other, can be achieved.

Since the dressings on the cylinders are not secured in grooves extending continuously over the length of the cylinders, but instead in grooves which are offset in respect to each other in the circumferential direction, a groove beating, in the course of the passage of the groove during the roll-off of two cylinders on each other, is considerably reduced. In an advantageous embodiment, in the case of two grooves arranged next to each other in the longitudinal direction, the grooves are arranged offset by 180° from each other.

The arrangement of the printing group cylinders and their grooves in such a way that the grooves of each cylinder, which are offset in respect to each other, roll off in the area of the opposite, offset groove of the cylinder working together with it, is particularly advantageous. A compensation of the dynamic forces can occur in this way. At a fixed offset angle of 180°, and with a linear arrangement of the cylinders, destructive interference occurs at all production rates, i.e. angular speeds, without an offset angle of the grooves needing to be changed as a function of the number of revolutions or the frequency.

The arrangement of printing group cylinders of single circumference is particularly advantageous for printed products of a small and/or of a variable number of pages and/or for print shops with restricted space availability. In comparison with the production of the same product on a printing press of double circumference (without assembling), no "double" plate change is required. In contrast to a printing press of double circumference, during assembling operations it becomes possible to create a page jump of two pages and in this way to produce increased flexibility in the printed product.

The type of construction, with all of the printing group cylinders being of a single circumference, permits a much more compact and easier construction, in comparison with printing groups having one or several cylinders of double circumference. Also, rubber blankets, which would have to be replaced in case of damage are smaller and therefore more cost-effective.

The use of printing blankets and printing plates makes it possible to seat the cylinders stably at both ends, which makes possible a simple, rugged and cost-effective construction of the frame receiving the printing group cylinders.

Also, in view of a rugged and simple construction, it is advantageous if only the transfer cylinders need to be moved for bringing the printing group into or out of contact with others. Although the forme cylinders can be movably seated for adjusting the distance to the associated transfer cylinder as well as to a possible inking system and, if provided, a dampening system, the placement against or away from each other of the transfer cylinders and the associated forme cylinders takes place in an advantageous manner only by a movement of the transfer cylinders.

The linear arrangement of the cylinders is made possible by a specially selected movement in the area of the printing position. At the same time, devices for movement into and out of contact, or movements into and out of contact of the forme cylinders are avoided. This, too, contributes to a rugged and simple construction.

For this purpose, in an advantageous embodiment of the present invention, the transfer cylinders are arranged in levers which are pivotably seated eccentrically with respect to the forme cylinder axis of rotation. Because of the special placement of the pivot points and because of the size of the eccentric with respect to the axis of rotation of the forme cylinder, together with the selected inclination with respect to the plane of the cylinders constituting the printing positions, or between the web and the plane of the cylinders, a rapid disengagement of the transfer cylinder from the associated cylinders, or the release of the web is possible. The operational engagement and disengagement is performed by the transfer cylinders alone, and, in a preferred embodiment, only by the use of a setting movement.

In a possible variation of the present invention, the transfer cylinders can be seated in double eccentric bushings. This support, at least in the area near the printing position, makes possible an almost linear movement of the transfer cylinder, which linear movement is, to a large extent, perpendicular with relation to the plane of the cylinder axes.

An effective groove width of the transfer cylinder groove or grooves is reduced because the dressings are embodied in the form of so-called metallic printing blankets on the transfer cylinders, because of which, an excitation of oscillations is further reduced in an advantageous manner. The non-printing area on the cylinders, i.e. the "white edge" on the product, as well as paper waste, are also reduced.

An embodiment of the printing group with cylinders of single circumference, and the arrangement in one plane, with offset grooves which, however, alternatingly roll off on each other, and with dressings which are embodied as metallic printing blankets on the transfer cylinders, is particularly advantageous.

Cylinders, or rollers, of printing groups must be moved away from each other out of an operating state designated as "print on", i.e. a print-on position, and then back into contact with each other particularly for washing, changing of dressings, and the like. The radial movement of the rollers required for this also contains a movement component in a tangential direction, whose size is a function of the structural design; i.e. the design of the levers, as well as angles with respect to the nip point of the setting device. If a speed difference is created on the active jacket surfaces at the nip point because of the displacement with relation to the operational state, this implies, because of the surface friction of the roller materials used, a tangential frictional force component which is directed opposite to the setting movement. Therefore, the setting movement is slowed by this, or its speed is limited. This is important, in particular with printing group cylinders in case of so-called "windings", since there large frictional forces also result from the high pressures occurring.

It is therefore advantageous in a method for bringing cylinders into and out of contact with each other, that a relative tangential speed in the area near the contact, i.e. in the area of the nip point, of two cylinders or rollers working together, is reduced by the intentional rotation, or turning, correlated with the movement, of at least one of the affected cylinders or rollers. Besides a reduction of the slowing of the displacement, an unnecessarily high load, such as caused by friction or deformation on the dressings and/or the jacket surfaces of the involved cylinders or rollers, is prevented.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
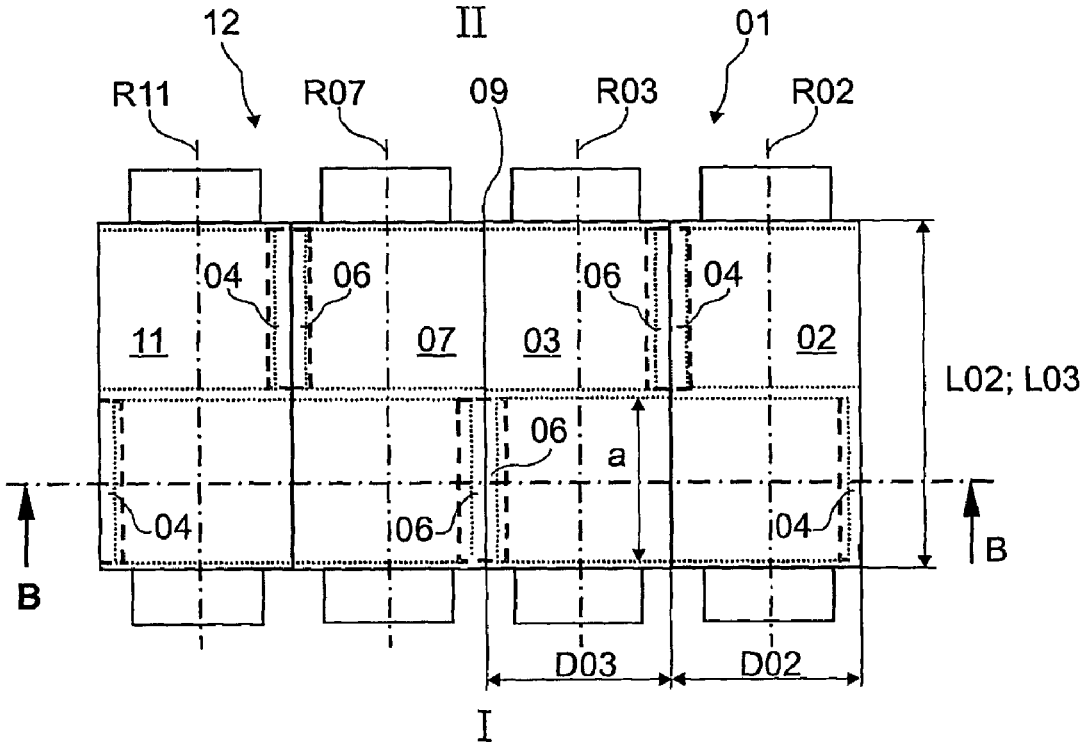
FIG. 1, a schematic representation of a double printing group.
Figure 5:
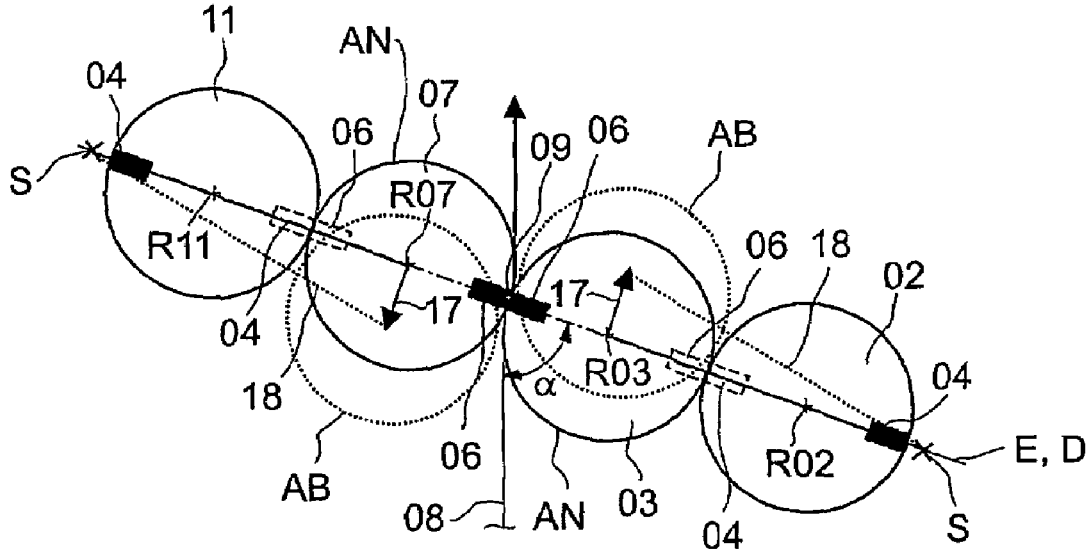

Referring initially to FIG. 1, there may be seen a first preferred embodiment of a printing couple in a printing machine, with a pivotable transfer cylinder, in accordance with the present invention. A first printing group 01 of a printing press, in particular a rotary printing press, has a first cylinder 02, for example a forme cylinder 02, and an associated second cylinder 03, for example a transfer cylinder 03. Their axes of rotation R02, R03 define a plane E in a print-on position AN, as seen in FIG. 5.

On their circumferences, the forme cylinder 02 and the transfer cylinder 03 each have at least one interference in the circumferential direction on the jacket surface, for example a disruption 04, 06 in the jacket surface which is active during roll-off. This disruption 04, 06, which can also be seen in FIG. 5 can be a joint between leading and trailing ends of one or several dressings, which are arranged on the circumference, for example by use of a magnetic force or by material-to-material contact. However, as represented in what follows in the preferred embodiments, these can also be grooves 04, 06, or slits 04, 06, which receive ends of dressings. The interferences, called grooves 04, 06 in what follows, are equivalent with other interruptions 04, 06 on the active jacket surface, i.e. the outward pointing face of the cylinders 02, 03 provided with dressings.

Each of the forme cylinders 02 and transfer cylinders 03 has at least two grooves 04, 06, or interruptions 04, 06, etc. These two grooves 04, 06 are respectively arranged one behind the other in the longitudinal direction of the cylinders 02, 03, and offset with respect to each other in the circumferential direction.

If the cylinders 02, 03 only have a length L02, L03, which substantially corresponds to two widths of a newspaper page, only two grooves 04, 06 are provided, which are offset in respect to each other in the circumferential direction and are arranged one behind the other in the longitudinal direction.

The grooves 04, 06 are arranged on the two cylinders 02, 03 in such a way that, in the course of a rotation of the two cylinders 02, 03, they roll off on one of the grooves 06, 04 of the other cylinder 03, 04, respectively. The offset of the grooves 04, 06 of each cylinder 02, 03 in the circumferential direction is preferably approximately 180°. Therefore, after one 180° rotation of the respective cylinders 02, 03, at least one pair of grooves 04, 06 rolls off on each other, while on a longitudinal section "a" of the cylinders 02, 03, as seen in FIG. 1, the cylinders 02, 03 roll off unimpeded on each other.

Figure 2:
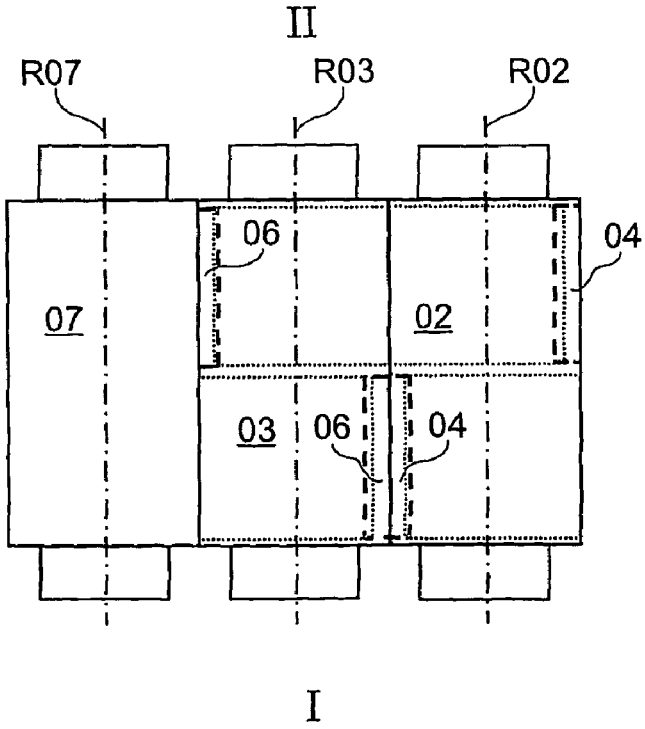
FIG. 2, a schematic representation of a three-cylinder offset printing group, FIG. 3, a schematic representation of a double-wide double printing group, FIG. 4, a schematic representation of a double-wide double printing group, which is highly symmetrical, FIG. 5, a schematic representation of a linear double printing group in a section taken along line B—B in FIG. 1, and with a curved setting track, FIG. 6, a schematic representation of a non-linear double printing group with a curved setting track, FIG. 7, a schematic representation of an H-printing group with a curved setting track, FIG. 8, a side view of the seating of the cylinders, FIG. 9, a cross-section through the seating in FIG. 8, FIG. 10, a portion of a device driving in pairs on the transfer cylinder, FIG. 11, a schematic front view, in accordance with FIG. 10, FIG. 12, a schematic front view of a double printing group with cylinders of differing circumference, FIG. 13, the coverage of the forme cylinder with four newspaper pages, FIG. 14, the coverage of the forme cylinder with eight tabloid pages, FIG. 15, the coverage of the forme cylinder with sixteen vertical pages in book format, and in FIG. 16, the coverage of the forme cylinder with sixteen horizontal pages in book format.
Figure 6:
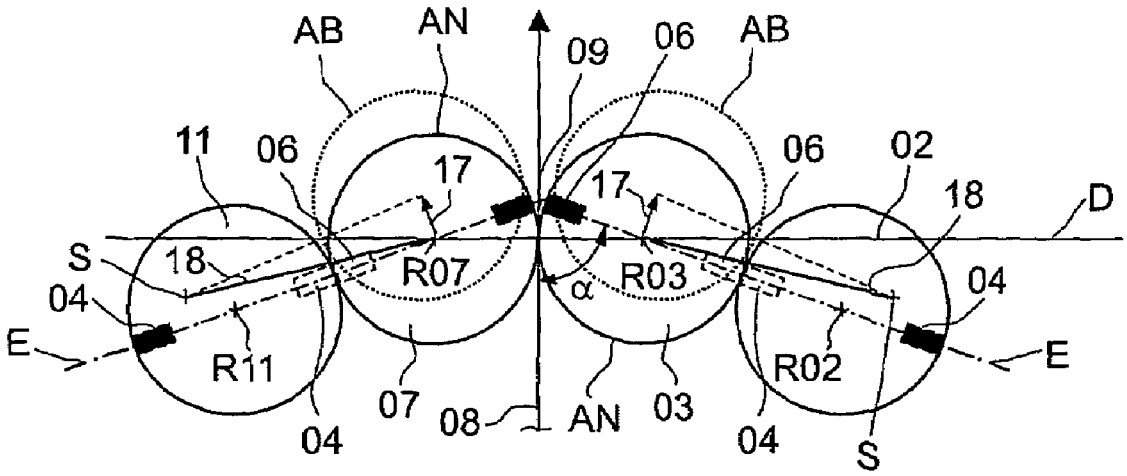

The transfer cylinder 01 of the first printing group 01 forms a printing position 09, together with a third cylinder 07, on a web 08, for example a web 08 of material to be imprinted, as seen in FIGS. 5 and 6. This third cylinder 07 can be embodied as a second transfer cylinder 07, shown in FIG. 1, or as a counter-pressure cylinder 07, as shown in FIG. 2, for example as a steel cylinder or as a satellite cylinder 07. In the print-on position AN shown in FIG. 6, the axes of rotation R03 and R07 of the cylinders 03, 07 forming the printing position 09 define a plane D.

In the embodiment of FIG. 5, in the print-on position AN the axes of rotation R02, R03, R07 of the three cylinders 02, 03, 07 working together are substantially located in a common plane E which, in this case, coincides with the plane D, and which planes D and E extend parallel with each other, as seen in FIG. 5. If the satellite cylinder 07 has two printing positions on its circumference, a second printing group, which is not specifically represented, is preferably also arranged in the common plane E. However, it can also define a plane E of its own, which is also different from the plane D associated with it.

As represented in the preferred embodiment in FIG. 1, the third cylinder 07, embodied as the second transfer cylinder 07, works together with a fourth cylinder 11, in particular a second forme cylinder 11 with an axis of rotation R11 and constitutes a second printing group 12. The two separate printing groups 01, 12 constitute a combined printing group 13, a so-called double printing group 13, which imprints both sides of the web 08 simultaneously.

As seen in FIG. 5, during printing, i.e. in the print-on position AN, all of the axes of rotation R02, R03, R07, R11 of the four cylinders 02, 03, 07, 11 are located in the common plane E or D and extend parallel with each other. FIG. 6 shows a corresponding printing group 13, wherein respective pairs of forme and transfer cylinders 02, 03, 11, 07 form one plane E, and the transfer cylinders 03, 07 form the plane D, which differs from the plane E.

In the case of the double printing group 13 shown in FIG. 1, the cylinders 07, 11 of the second printing group 12 also have grooves 04, 06 with the properties regarding the number and offset in respect to each other already described above in connection with the first printing group 01. Now the grooves 04, 06 of the four cylinders 02, 03, 07, 11 are preferably arranged in such a way that respectively two grooves 04, 06 of two cylinders 02, 03, 07, 11 which work together roll off on each other.

Figure 3:
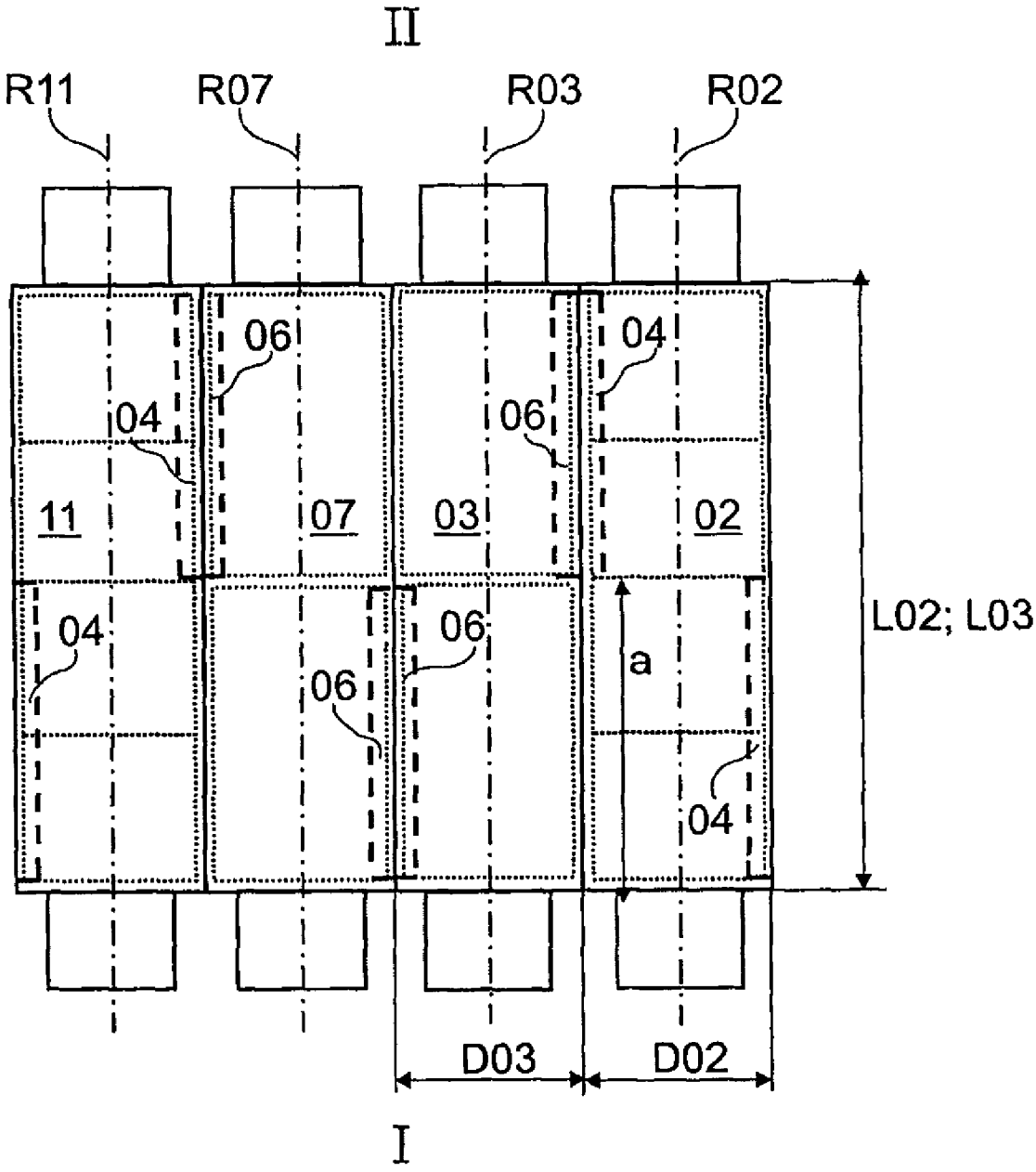
Figure 4:
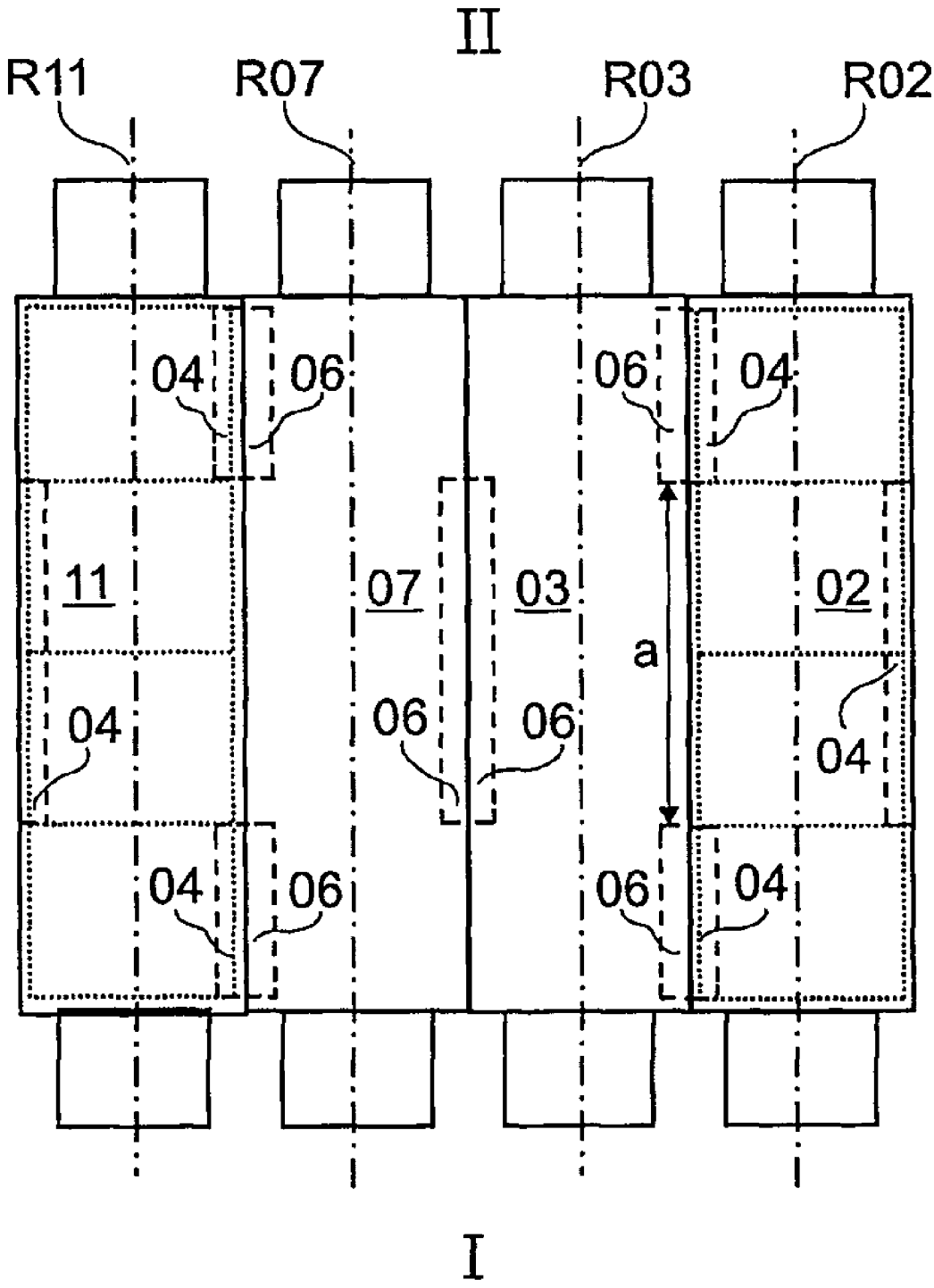

In an advantageous embodiment, the forme cylinder 02 and the transfer cylinder 03 each have a length L02, L03, which corresponds to four or more widths of a printed page, for example a newspaper page, for example 1,100 to 1,800 mm, and in particular to 1,500 to 1,700 mm, and a diameter D02, D03, for example 130 to 200 mm, and in particular of 145 to 185 mm, whose circumference substantially corresponds to the length of a newspaper page, "single circumference", as seen in FIGS. 3 and 4 in what follows. The device is also advantageous for other circumferences, wherein the ratio between the circumferences D02, D03 and the length L02, L03 of the cylinders 02, 03 is less than or equal to 0.16, in particular less than 0.12, or even less than or equal to 0.08.

In an advantageous embodiment, each of the two cylinders 02, 03 has two grooves 04, 06, each of which extends continuously at least over a length corresponding to two widths of a newspaper page (FIG. 3).

More than two grooves 04, 06 can be arranged per cylinder 02, 03. In this case, respectively two grooves 04, 06 arranged next to each other can be arranged aligned, or respectively alternatingly. However, for example with four grooves 04, 06, the two grooves 04, 06 adjoining the front ends of the cylinders 02, 03 can be arranged in a common alignment, and the two grooves 04, 06 located on the "inside" can be arranged in a common alignment, but offset in the circumferential direction in respect to the first mentioned ones, as depicted in FIG. 4.

If the interruptions 04, 06 are actually embodied as grooves 04, 06, or as slits 04, 06, the grooves 04, 06 schematically represented in FIGS. 1 to 4 can be slightly longer than the width, or twice the width of the printed page. In the circumferential direction, they can also possibly slightly overlap two grooves 04, 06 adjoining each other in the longitudinal direction. This is not shown in such detail in FIGS. 1 to 4, which are only schematic representations.

In view of the excitation, or the damping of oscillations caused by groove beating, it is particularly advantageous if the grooves 04, 06 on the respective cylinders 02, 03, 07, 11 are offset by 180° from each other. In this case the grooves 04, 06 between the forme cylinders 02, 11 and the transfer cylinders 03, 07 of the two printing groups 01, 12 roll off simultaneously and in the area of the same section in the longitudinal direction of the cylinders 02, 03, 07, 11, in one stage of the cycle for example on the same side, for example a side I, as seen in FIGS. 1, 3 and 4 of the double printing group 13, and in the other phase on a side II or, with more than two grooves 04, 06 per cylinder 02, 03, 07, 11, for example in the area of the center of the cylinders 02, 03, 07, 11.

The excitation of oscillations is considerably reduced by the offset arrangement of the grooves 04, 06 and the roll-off of all grooves 04, 06 in the described manner, and possibly also by the linear arrangement of the cylinders 02, 03, 07, 11 in one plane E. Because of the synchronous, and possibly symmetrical roll-off on the two printing groups 01, 12, a destructive interference with the excitation occurs which, with the selection of the offset by 180° of the grooves 04, 06 on the cylinders 02, 03, 07, 11, takes place independently of the number of revolutions of the cylinders 02, 03, 07, 11, or of the frequency.

If the interruptions 04, 06 are actually embodied as grooves 04, 06, in an advantageous embodiment they are embodied with a gap of only little width, for example less than or equal to 3 mm, in the area of a jacket surface of the forme cylinders 02, 11, or of the transfer cylinders 03, 07, which gap receives ends of one or several dressings, for example one or several rubber blankets, on the transfer cylinder 03, 07, or ends of one or several dressings, for example one or several printing plates, on the forme cylinders 02, 11. The dressing on the transfer cylinder 03, 07 is preferably embodied as a so-called metallic printing blanket, which has an ink-conducting layer on a metallic base plate. In the case of the transfer cylinders 03, 07, the beveled edges of the dressings are secured by clamping and/or bracing devices, for example, and in the case of forme cylinders 02, 11 by clamping devices, in the grooves 04, 06.

A single, continuous clamping and/or bracing device can be arranged in each one of the grooves 06 of the transfer cylinder 03 or, in case of grooves extending over several widths of newspaper pages, several clamping and/or bracing devices can be arranged one behind the other in the longitudinal direction. The grooves 04 of the forme cylinder 02, for example, also have a single, or several clamping devices.

A "minigap technology" is preferably employed in the grooves 04 of the forme cylinders 02, 11, as well as in the grooves 06 of the transfer cylinders 03, 07, wherein a leading dressing end is inserted into a narrow groove 04, 06 with an inclined extending suspension edge, the dressing is wound on the cylinders 02, 03, 07, 11, the trailing end is also pushed into the groove 04, 06, and the ends are clamped, for example by use of a rotatable spindle or a pneumatic device, to prevent them from sliding out.

However, it is also possible to arrange a groove 04, 06 embodied as a narrow slit 04, 06 without a clamping device for the dressing on the forme cylinders 02, 11, as well as for the dressing, embodied as a metallic printing blanket, of the transfer cylinders 03, 07, which receives the ends of the dressings. In this case, the plate or ends are secured in the slit 04, 06 by their shaping and/or the geometry of the slit 04, 06.

For example, in an advantageous embodiment, as depicted in FIG. 3, the transfer cylinders 03, 07 have only two dressings, which are offset by 180° from each other in the circumferential direction, each of which dressings has at least a width corresponding to two widths of a newspaper page. In this case, the dressings, or the grooves 04 of the forme cylinders 02, 11, extend complementary thereto must have either, as represented, two continuous grooves 04, each of the length of two widths of a newspaper page, or grooves 04 which adjoin in pairs and are arranged aligned, each of the length of two widths of a newspaper page. In the first case, in an advantageous embodiment, each interruption 04 of the forme cylinder 02, 11 actually embodied as a groove 04 which has two clamping devices, each of a length substantially corresponding to the width of a newspaper page.

In an advantageous embodiment, the forme cylinders 02, 11 are covered with four flexible dressings, which adjoin each other in the longitudinal direction of the forme cylinders 02, 11 and which have a length in the circumferential direction slightly greater than the length of a printed image of a newspaper page, and in the longitudinal direction have a width of approximately one newspaper page. With the arrangement of continuous grooves 04 and with only one clamping device per groove 04, 06, which has a length of two widths of a newspaper page, it is also possible to apply dressings of a width of two newspaper pages, which dressings are so-called panoramic printing plates.

In connection with printing groups for which the need for a setup with panoramic printing plates can be excluded, an arrangement can also be of advantage in which the "outer" dressings, which respectively adjoin the side I and the side II, are aligned with each other, and the "inner" dressings are aligned with each other and are arranged offset by 180° from the first mentioned ones, as seen in FIG. 4. This highly symmetrical arrangement makes it additionally possible to minimize, or to prevent, the danger of an oscillation excitation in the plane E, which might result from the non-simultaneous passage of the grooves 04, 06 on the sides 1 and 11. The alternating tensing and relaxation of the web 08 occurring alternatingly on the sides 1 and 11, and oscillations of the web 08 caused thereby, can also be avoided by this.

In a further development, the above-mentioned arrangement of the interruptions 04, 06 on the respective cylinders 02, 03, 07, 11, as well as between the cylinders 02, 03, 07, 11, and the possibly linear arrangement of the cylinders 02, 03, 07, 11, can be applied in particular to cylinders of a length L02, L03 substantially corresponding to six times the width of a newspaper page. However, in this case it can be advantageous to embody the transfer cylinders 03, 07 and/or the forme cylinders 02, 11 with a diameter D02, D03 which results in a circumference which substantially corresponds to double the length of a newspaper page.

In an advantageous embodiment, for a mechanically simple and rugged embodiment of the double printing group 13, the forme cylinders 02, 11 are arranged fixed with respect to their axes of rotation R02, R11. For bringing the printing groups 01, 12 in and out of contact, the transfer cylinders 03, 07 are embodied to be movable by shifting their axes of rotation R03, R07, and can each be simultaneously moved away from their associated forme cylinders 02, 11 and transfer cylinders 03, 07 working together with them, or can be placed against them. In this embodiment, only the transfer cylinders 03, 07 are moved in the course of normal operation of the printing press, while the forme cylinders 02, 11 remain in their fixed and possibly previously adjusted position. However, the forme cylinders 02, 11 can also be seated in appropriate devices, for example in eccentric or double eccentric bushings, in linear guide devices or on levers, for adjustment, if necessary.

As represented schematically in FIGS. 5 and 6, the transfer cylinders 03, 07 can be movable along a curved setting track 17. The setting track 17, as well as the transfer cylinders 03, 07 in a print-off position AB, are represented in dashed lines in FIG. 5.

One of the transfer cylinders 03 is seated, pivotable around a pivot axis S, in a lever 18, as schematically represented in FIG. 5. Here, the pivot axis S is located in the plane E, for example. In this case, the lever 18 has a length between the seating of the axes of rotation R03, R07 of the transfer cylinders 03, 07 and the pivot axis S, which is greater than the distance of the axes of rotation R03, R07 of the transfer cylinders 03, 07 from the axes of rotation R02, R11 of the associated forme cylinders 02, 11 in the print-on position AN. In this way, the simultaneous disengagement of the cooperating transfer cylinders 03, 07 and the associated forme cylinders 02, 11 takes place, and for the engagement the opposite action occurs.

However, as described in greater detail below, the pivot axis S can, in particular, be arranged in a different way eccentrically with respect to the axes of rotation R02, R11 of the associated forme cylinders 02, 11, for example at a distance from the plane E. Seating in a lever 18 takes place preferably on the side I and the side II of the double printing group 13.

In a further preferred embodiment, which is not specifically represented, the setting track 17 can be formed by seating the transfer cylinders 03, 07 in eccentric bushings, and in particular in double eccentric bushing, which are not represented. It is possible, by the use of double eccentric bushings, to form a substantially linear setting track in the area of the print-on position AN, but to provide, in the area remote from the printing position 09, a curved setting track 17, if required, which permits a faster or a greater movement out of contact of the transfer cylinders 03, 07 from the cooperating transfer cylinder 07, 03 than from the assigned forme cylinders 02, 11, or vice versa. Seating on side I and on side II of the double printing group 13 is also advantageous for the employment of eccentric cams.

The course of the web 08 through the printing position 09, which is in the print-on position AN, is also represented in FIGS. 5 and 6. The plane E of the double printing group 13, shown in FIG. 5, or of the respective printing group 01, 02, shown in FIGS. 5, 6, and the plane of the web 08 intersect in an advantageous embodiment at an angle $\alpha$ of 700 to 850. If the transfer cylinders 03, 07 have a circumference approximately corresponding to the length of one newspaper page, the angle $\alpha$ should be selected to be approximately 75° to 80°, for example, preferably approximately 77°, but if the transfer cylinders 03, 07 have a circumference approximately corresponding to two newspaper pages, the angle $\alpha$ should be selected to be approximately 80 to 85°, for example, preferably approximately 83°. For one, this selection of the angle $\alpha$ takes into account the assured and rapid access to the web 08 and/or the moving apart from each other of the transfer cylinders 03, 07 over a minimized setting track 17, and also minimizes negative effects on the result of printing, such as mackling or smearing, which is decisively affected by the amount of a partial looping around the transfer cylinder(s) 03, 07 by the web 08.

At least one of the transfer cylinders 03, 07 can be advantageously brought out of contact sufficiently far so that, during printing operations, the drawn-in web 08 can be moved through the printing position 09 without touching it.

Figure 7:
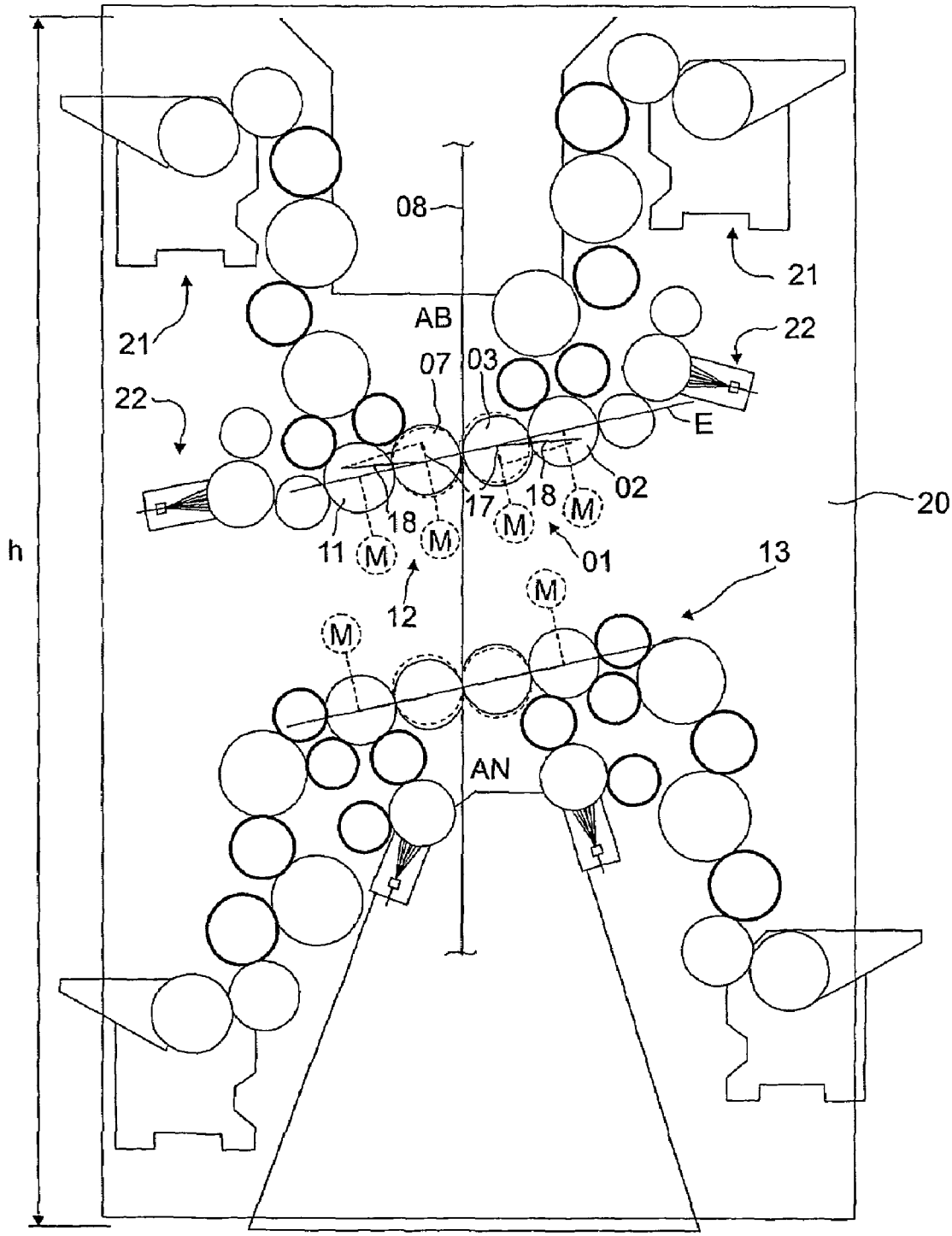

The double printing group 13, depicted here in a linear embodiment can be multiply employed, for example twice, as represented in FIG. 7, in a printing unit 19, for example a so-called H-printing unit 19, in a common lateral frame 20. In FIG. 7, a separate identification of the respective parts of the lower located double printing group 13, which are identical to the upper double printing group 13, has been omitted. With an arrangement of all cylinders 02, 03, 07, 11 whose circumference substantially corresponds to the length of a newspaper page, it is possible to save structural space, i.e. a height "h" of the printing unit 19. This of course also applies to individual printing groups 01, 12 for double printing groups 13, as well as for otherwise configured printing units having several printing groups 01, 12. However, an improved accessibility of the cylinders 02, 03, 07, 11, for example for changing dressings, cleaning work and washing, maintenance, and the like, can also be a priority in place of a savings in height "h."

The print-on, or -off positions AN, AB have been drawn in bold or full lines in all of the drawing figures, for the purpose of clarity. In FIG. 7, the transfer cylinders 03, 07 are indicated in dashed lines in a second possible position along the setting track 17, wherein, for example, the upper double printing group 13 is operated in the print-off AB position, shown in solid lines, for example for a printing forme change, and the lower double printing group 13 is operated in the print-on position AN, shown in solid lines, for example for continued production.

In an advantageous embodiment of the present invention, each one of the printing groups 01, 12 has at least one drive motor 14 of its own for the rotatory driving of the cylinders 02, 03, 07, 11. The drive motor 14 is embodied as an electric motor, and in particular as an asynchronous motor, a synchronous motor, or as a dc motor.

In a schematically represented embodiment shown in FIG. 7, this can be a single drive motor 14 for the respective printing group 01, 12 which, in an advantageous embodiment, in this case initially drives the forme cylinders 02, 11, and power is transferred from there via a mechanical drive connection, for example by spur wheels, toothed belts, and the like, to the transfer cylinders 03, 07. However, for reasons of space and for reasons of the flow of moments, it can also be of advantage to transfer power from the drive motor 14 to the transfer cylinders 03, 07, and from there to the forme cylinders 02, 11.

In one embodiment, a printing group 01, 12 has its own drive motor 14 for each cylinder 02, 03, 07, 11, as seen in FIG. 7, which drive motor 14 for each cylinder is mechanically independent of the remaining drive mechanisms and has a large degree of flexibility in the various operating situations, such as production runs, registration, dressing changes, washing, web draw-in, and the like.

For special requirements, for example for only one-sided imprinter operations, or merely for the requirement for changing the relative angle of rotation position of the forme cylinders 02, 11 in relation to each other, driving is also possible wherein one of the forme cylinders 02, 11 of a printing group 01, 12 has its own drive motor 14, and the remaining cylinders 02, 03, 07, 11 of the printing group 01, 12 have a common drive motor 14.

The type of drive mechanism in FIG. 7, either top and bottom is represented by way of example and can therefore be transferred to the respectively other printing groups 01, 12, or to the other double printing group 13.

In an advantageous embodiment, driving by operation of the drive motor 14 takes place coaxially between the axes of rotation R02, R03, R07, R11 and the motor shaft, if required with a coupling for compensating for angles and/or offset, as will be explained in greater detail below. However, driving can also take place via a pinion, in case the "moving along" of the motor 14, or a flexible coupling between the drive motor and the cylinders 02, 03, 07, 11, which are to be moved when required, is to be avoided.

If a drive motor 14 driving the transfer cylinder 03, 07 is to be taken along in the course of the setting movement, in a further development it can also be taken along on an appropriate guide device on the outside of the lateral frame 20, for example.

In further development of the preferred embodiments, it is advantageous if the inking system 21 assigned to the respective forme cylinders 02, 11 and, if provided, the associated dampening unit 22, is rotationally driven by a drive motor which is independent of the drive mechanism of the printing group cylinders. In particular, the inking system 21 and the possibly also provided dampening system 22 can each have their own drive motors. In the case of an anilox inking system 21, the screen roller, and in connection with a roller inking system 21, for example, the friction cylinder, or cylinders, can be rotationally driven individually or in groups. Also, the friction cylinder, or cylinders of a dampening system 22 can also be rotationally driven individually or in groups.

Figure 8:
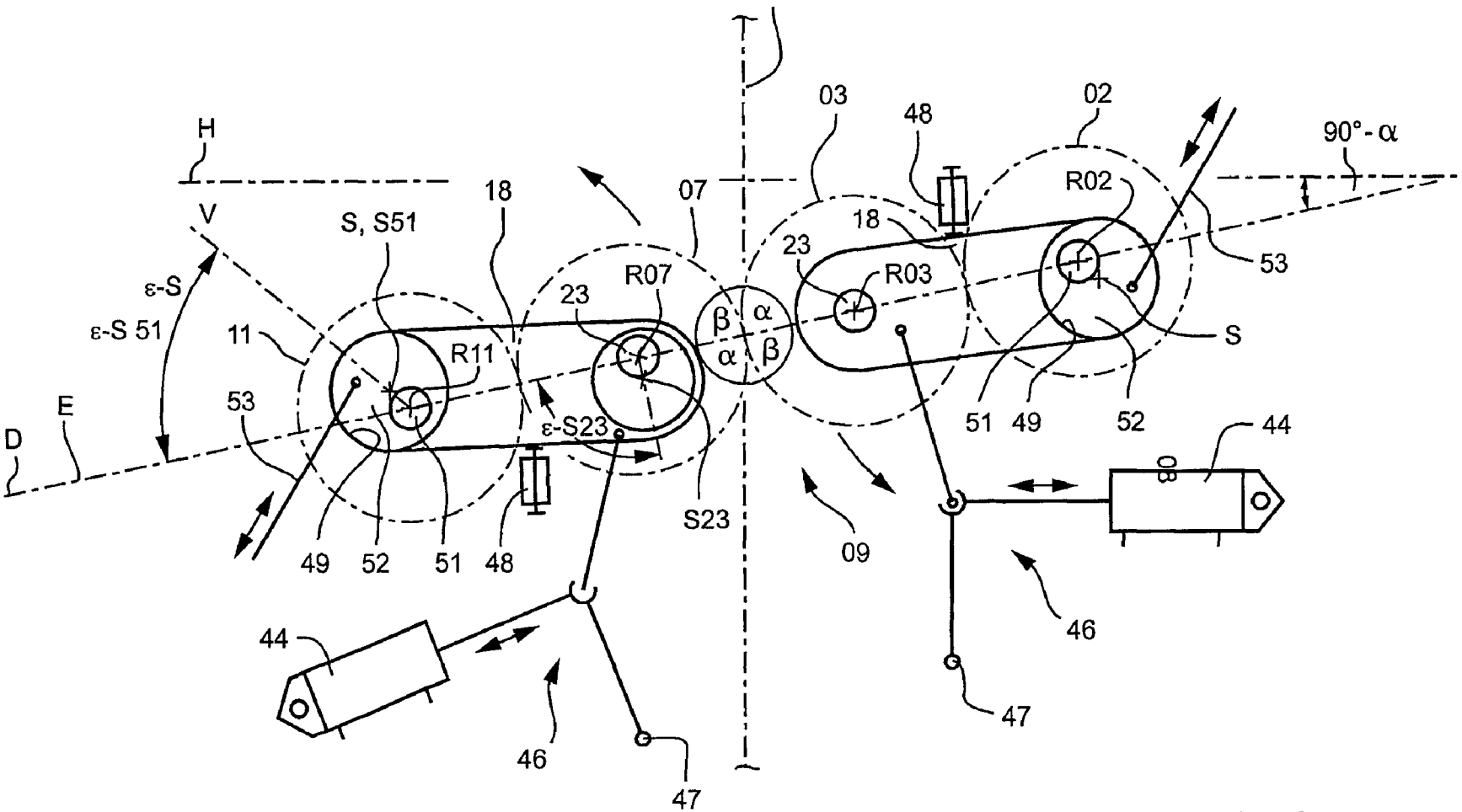
Figure 9:
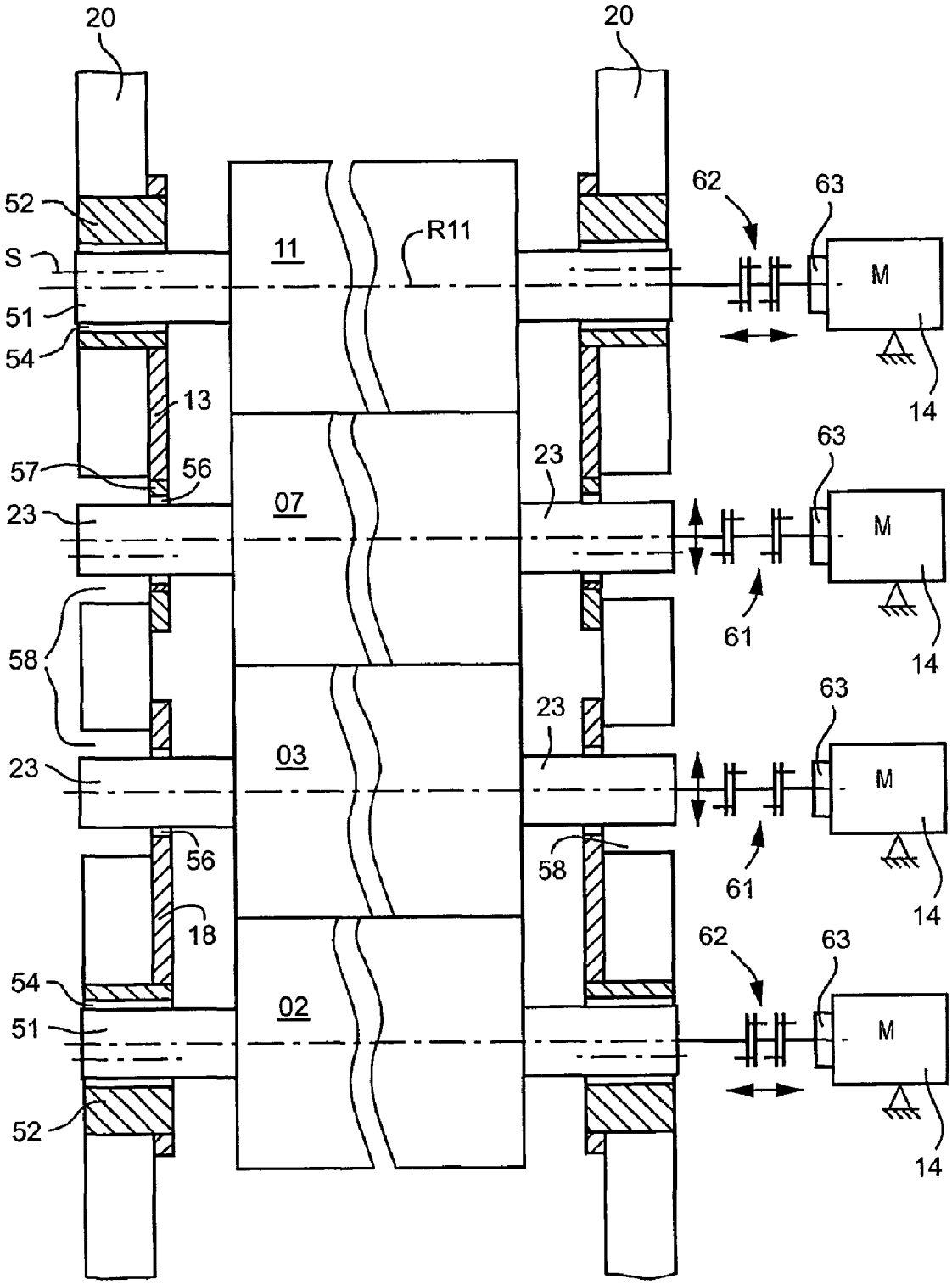

A preferred embodiment for providing the linear curved setting track 17 by use of the lever 18 is represented in FIGS. 8 and 9.

FIG. 8 shows a lateral view, in which only one of two journals 23 which are arranged on the fronts of the transfer cylinders 03, 07, shown in dashed lines is visible. The lever 18 is seated, pivotable around the pivot axis S, which is preferably fixed in place, but which can be adjustable, if required, with respect to the lateral frame 20. In the embodiment represented, in a print-on position AN, the axes of rotation R02, R03, R07, R11 of the cylinders 02, 03, 07, 11 shown in dashed lines, are again located in a plane E, which, in this case, coincides with the plane D between the cylinders 03, 07 which form printing positions 09.

The pivot axis S of the lever 18 is arranged eccentrically with respect to the axes of rotation R02, R11 of the forme cylinders 02, 11 and is located outside the plane E or D. Pivoting of the lever 18 around the pivot axis S by use of a drive mechanism 44, for example by use of a pressure medium cylinder 44, via a setting assembly 46, for example a single- or multi-part connector 46, for example a lever or toggle lever mechanism 46, causes the transfer cylinders 03, 07 to be simultaneously brought out of and into contact with the assigned forme cylinders 02, 11, or with the respectively other transfer cylinders 07, 03. The toggle lever mechanism 46 is hingedly connected with the lever 18 and with a pivot point fixed on the frame. The advantageously double-acting pressure medium cylinder acts, for example, on a movable joint of the toggle lever mechanism. The axes of rotation R02, R11 of the forme cylinders 02, 11 remain at rest for this process. So that the movement of the two levers 18 for the transfer cylinder 03, 07, which are arranged on the front face, takes place synchronously, the setting assembly 44 can have a shaft 47, for example a synchronous shaft 47, which connects the two setting assemblies 44, or can be connected with such a one. To assure the desired, for example linear, arrangement of the cylinders 02, 03, 07, 11, a stop 48, which is preferably embodied to be adjustable, is provided for each lever 18.

The driving and setting assemblies 44, 46 are structured and arranged in such a way that the movement out of contact of the transfer cylinders 03, 07 takes respectively place in the direction of the obtuse angle $\beta$ for a straight web run $180°-\alpha$) between the web 08 and the plane D or E.

The eccentricity e-S of the pivot axis S with respect to the axes of rotation R02, R11 of the forme cylinders 02, 11 lies between 7 and 15 mm, and in particular is approximately 9 to 12 mm. In the contact position of the transfer cylinders 03, 07, i.e. the axes of rotation R03, R07 lie in the above mentioned plane D, the eccentricity e-S is oriented in such a way, that an angle $\epsilon$-S between the plane D of the cylinders 03, 07 forming the printing position 09 and the connecting plane V of the pivot axis S and the axes of rotation R02, R11 lies between 25° and 65°, advantageously between 32° and 55°, and in particular lies between 38° and 52°, wherein the pivot axis S lies preferably in the area of an obtuse angle $\beta$ between the plane D and the incoming or outgoing web 08, and is farther apart from the printing position 09 than the axes of rotation R02, R11 of the associated forme cylinders 02, 11. In case of a vertical and, except for a possible offset caused by the partial looping around, straight path of the web, as well as an angle of 77° between the plane D and the plane of the web 08, the eccentrics e-S have an angle of, for example 12° to 52°, advantageously 19° to 42°, and in particular between 25° to 39°, with respect to a horizontal line H.

In the ideal case, i.e. with never-changing conditions and with a tolerance-free production, the arrangement as described so far meets the demands made on putting the printing groups 01, 12, or the double printing group 13, into and out of contact without further setting mechanisms.

However, for compensating for possibly occurring production tolerances, and/or for being able to perform a base positioning of the dressings, materials to be imprinted, etc., further actuating options for adjusting purposes are provided.

The axes of rotation R02, R11 on the forme cylinders 02, 11 are seated adjustably, for example also eccentrically in respect to their fastening on the lateral frame 20, in this case with respect to a bore 49. In the present case, a journal 51 of the forme cylinders 02, 11 is arranged in an eccentric bearing 52, or in an eccentric bearing bushing 52, which is pivotably seated in the bore 49.

A pivot axis S51 of the forme cylinders 02, 11 is eccentrically arranged by an eccentricity of 5 to 15 mm, in particular an eccentricity of approximately 7 to 12 mm, in respect to the axes of rotation R02, R11 of the forme cylinders 02, 11, and is located outside of the plane E.

In the contact position between the forme cylinders and the associated transfer cylinders 02, 03, 07, 11, in which the axes of rotation R0, R03, or R11, R07 are located in the plane E, the eccentricity e-S51 is oriented in such a way that an angle ϵ-S51 between the plane E of the pair of cylinders 02, 03, or 02, 11, and a connecting plane of the pivot axis S51 and the axes of rotation R02, R1 of the forme cylinders 02, 11 lies between 25° and 65°, advantageously between 32° and 55°, and in particular lies between 38° and 52°. The pivot axis S5 is preferably located in a half plane which is farther removed from the axes of rotation R03, R07 of the associated transfer cylinders 03, 07 than the axes of rotation R02, R11 of the associated forme cylinders 02, 11.

In the preferred embodiment in accordance with FIG. 8, the pivot axis S51 for the eccentric seating of the forme cylinders 02, 11 coincides with the pivot axis S of the lever 18.

The coincidence of the pivot axes S and S51 is not absolutely necessary, but is practical. In particular, the pivot axis S, which is stationary with respect to the lateral frame 20 and is not affected by the pivoting of the forme cylinders 02, 11, permits a simple and exact adjustment. In principle, the lever 18 could also be arranged on an eccentric flange of the bearing bushing 52 which receives the journals 51, but during turning, this would result in a simultaneous displacement of the distances between the forme cylinders 02, 11 and the transfer cylinders 03, 07, as well as between the transfer cylinders 03, 07.

In an advantageous embodiment, the two pivot axes S51 (and/or S) and S23 of pairs of forme and transfer cylinders 02, 03, 11, 07 are arranged on two different sides of the plane E in the print-on position AN.

The position of the forme cylinders 02, 11 can be adjusted by the provision of a second adjusting assembly 53 in accordance with the desired position in respect to the plane E, or in regard to the required distance from the transfer cylinders 03, 07 for the print-on position AN, by a slight twisting of the eccentric bearing 52. After it has been adjusted, this position is set, for example, by an assembly which is not represented.

For adjusting the printing gap at the printing position 09 into the print-on position AN, at least the journals 23 of one of the two transfer cylinders 03, 07, in this case the transfer cylinder 07, can be adjusted. For example, they are also eccentrically seated in the assigned lever 18. An eccentricity e-s23 of a pivot axis S23 with respect to the axes of rotation R03, R07 of the transfer cylinder, lies between 1 and 4 mm, and in particular approximately at 2 mm. In the contact position of the cylinders 03, 07 forming the printing position 09, i.e. when the axes of rotation R03, R07 are located in the plane D, the eccentricity e-S23 is oriented in such a way that an angle ϵ-S23 between the plane D and the connecting plane of the pivot axis S23 and the axes of rotation R07 (R03) lies between 70° and 110°, advantageously between 80° and 100°, and in particular lies between 85° and 95°. In the example, the angle ϵ-S23 should be approximately 90°.

An embodiment in accordance with FIG. 8 is represented in FIG. 9 in a section taken along the plane E of FIG. 8. Each of the journals 51 of the forme cylinders 02, 07 is rotatably seated in bearings 54, for example in rolling bearings 54. In order to be able to provide a setting, or a correction of the lateral register, this bearing 54, or an additional axial bearing, not represented, makes possible in an advantageous embodiment the movement of the forme cylinders 02, 11, or their journals 51, in the axial direction. The bearings 54 are arranged in the eccentric bearing 52, or in the eccentric bearing bushing 52, which, in turn, are arranged pivotably in the bore 49 in the lateral frame 20. Besides the eccentric bearing bushing 52 and the bearing 54, further bearing rings and friction bearings or rolling bearings can be arranged between the bore 49 and the journals 51. The lever 18 is seated on a part of the bearing bushing 52 projecting from the lateral frame 20 in the direction toward the forme cylinders 02, 11, and is pivotably seated in relation to it. On its end remote from the pivot axis S, the lever 18 receives the journal 23 of the transfer cylinders 03, 07, which is arranged, rotatable in a bearing 56, and the latter, in the case of the transfer cylinder 07, is arranged, pivotable around the pivot axis S-23, in an eccentric bearing 57, or in an eccentric bearing bushing 57. If required, a bearing bushing 57 which is pivotable in such a way can also be arranged for both transfer cylinders 03, 07.

The lateral frame 20 advantageously has recesses 58, at least on the driven side of the printing press, in which the journals 23 of the transfer cylinders 03, 07 can be pivoted. The setting assemblies 46, 53, or the drive assemblies 44, are not represented in FIG. 8.

The rotatory drive of the cylinders 02, 03, 07, 11 is provided by respectively individual drive motors 14, which are mechanically independent from the drive mechanisms of the respectively other cylinders 02, 03, 07, 11 and which are preferably arranged fixed in place on the frame. The latter has the advantage that the drive motors 14 need not be moved.

For compensating for the pivot movement of the transfer cylinders 03, 07, a coupling 61, which compensates for the angles and the offset, is arranged between the transfer cylinders and the drive motor 14. It can be embodied as a double joint 61 or, in an advantageous embodiment can be embodied as an all-metal coupling 61 with two torsionally rigid, but axially deformable multi-disk packets. The all-metal coupling can simultaneously compensate for the offset and the position change caused by this. It is important that the rotatory movement be transmitted free of play.

Between the journal 51 and the drive motor 14, the drive mechanism of the forme cylinders 02, 11 also has a coupling 62, which absorbs at least an axial relative movement between the cylinders 02, 11 and the drive motor 14. For also being able to absorb production tolerances and possibly required movements of the forme cylinders 02, 11 for adjusting purposes, the coupling 62 is also embodied as a coupling 62 for compensating at least minute angles and offsets. In an advantageous embodiment, it is also embodied as an all-metal coupling 62, with two torsionally rigid, but axially deformable multi-disk packets. The axial movement is absorbed by the provision of multi-disk packets, which are positively connected in the axial direction with the journal 51, or with a shaft of the drive motor 14.

For the case of of the cylinders 02, 03, 07, 11 being driven in pairs, as is schematically indicated in FIG. 6 in the lower double printing group 13, the forme cylinder 02, 11 is driven, for example, by the attached gear 63 or a pinion to a drive wheel of the forme cylinder 02, 11. Here the embodiment of cooperating drive wheels between the forme and transfer cylinders 02, 03, 07, 11, each with spur toothing, is of advantage. The latter also applies for a pinion which is possibly arranged between the drive motor 14 and the drive wheel of the forme cylinder 02, 11. An above mentioned individual encapsulation in this case extends around the paired drive mechanisms of two cylinders 02, 03, 07, 11.

Figure 10:
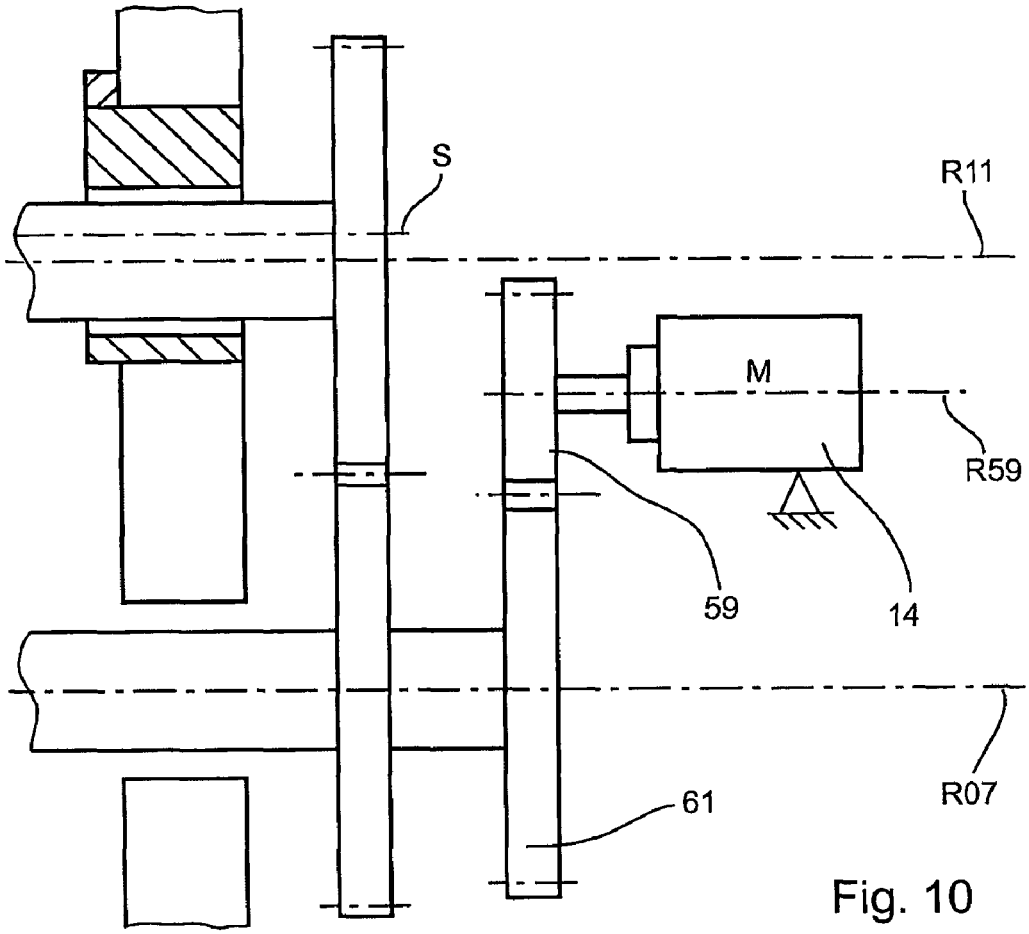
Figure 11:
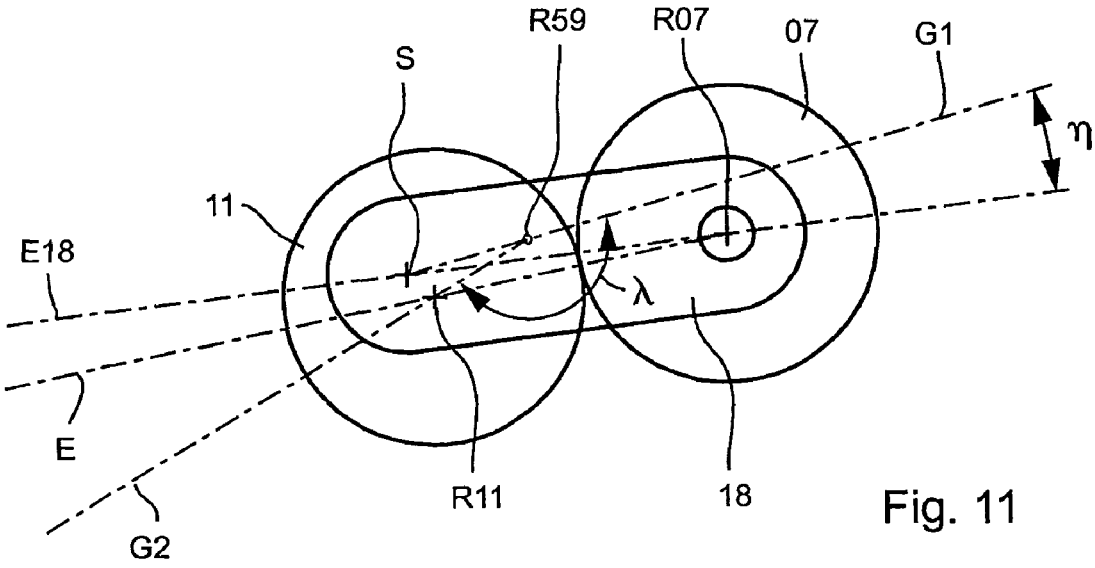

In a variation which is represented in FIGS. 10 and 11, a drive in pairs can also take place from the drive motor 14, and if required, via further gear elements, not represented, via a pinion 59 to a drive wheel 61 of the transfer cylinders 03, 07, for example if it is intended to achieve a special flow of moments or torque.

In that case, an axis of rotation R59 of the pinion 59 is arranged fixed on the frame in such a way that a straight line G1 determined by the axis of rotation R59 of the pinion 59 and the pivot axis S of the lever 18, together with a plane E18, determined by the pivot axis S of the lever 18 and the axes of rotation of the R03, R07 of the transfer cylinders 03, 07, defines an opening angle $\eta$ in the range between +20° to −20°.

In a further development, a straight line G2 determined by the axes of rotation R02, R11 of the forme cylinders 02, 11 and the axis of rotation R59 of the pinion 59, together with the straight line G1 determined by the axis of rotation R59 of the pinion 59 and the pivot axis S of the lever 18, defines an opening angle A in the range between 160° and 200°.

Figure 12:
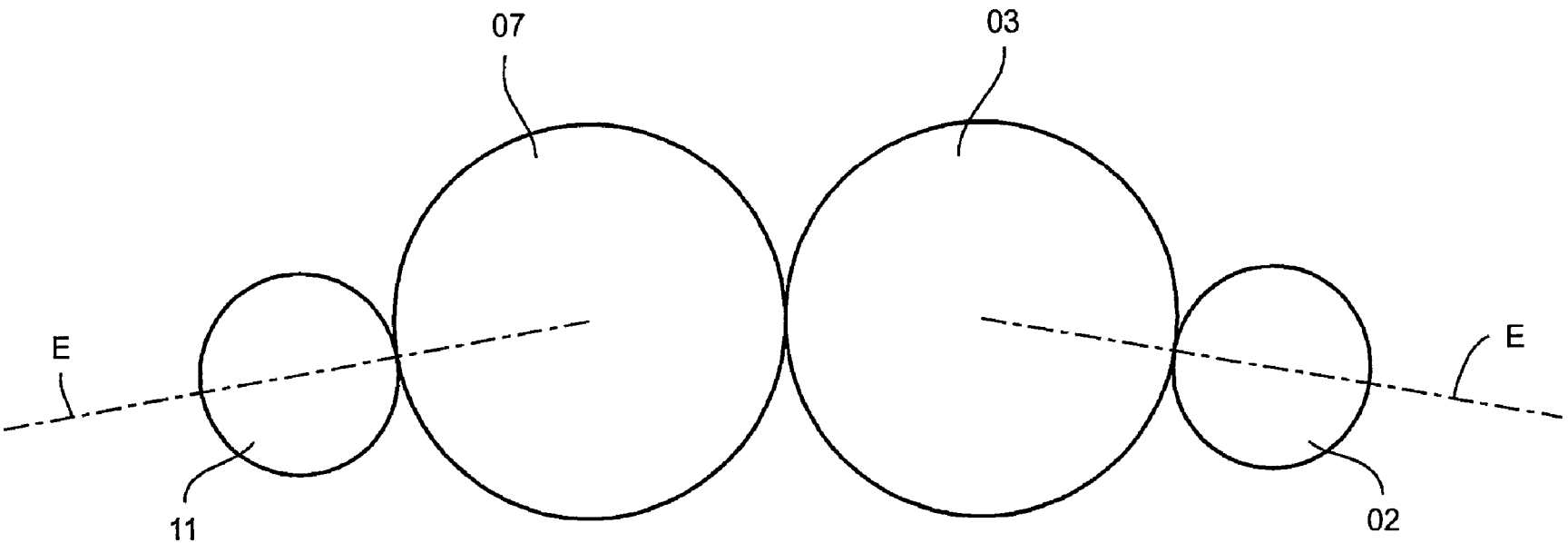

The above mentioned embodiments for driving, as well as for pivoting, the transfer cylinders 03, 07, and the embodiment of the lever 18 are to be applied in the same way to printing groups in which the cylinders 02, 03, 07, 11 do not all have the same circumference, or diameter, as seen in FIG. 12. For example, the forme cylinder(s) 02, 11 can have a circumference U which has one printed page, for example the longitudinal page of a newspaper, a "single circumference" in what follows. The cooperating transfer cylinders 03, 07 have, for example, a circumference or diameter, which corresponds to a whole number multiple, greater than 1 of that of the forme cylinders 02, 11, i.e. it has a circumference, for example, of two or even three printed pages of newspaper format, or is correspondingly matched to other formats.

If the printing position is constituted by a transfer cylinder 03, 07 and a counter-pressure cylinder 07, 03, embodied as a satellite cylinder 07, 03, the forme and the transfer cylinders 02, 11, 03, 07 can also have a single circumference, and the assigned counter-pressure cylinder 07, 03 can be designed larger by a multiple.

An increased rigidity of the printing groups is also achieved, in an advantageous manner, by the use of the above-mentioned embodiments. This has a particular advantage, particularly in connection with cylinders 02, 03, 07, 11 which have a length which corresponds to at least four, or even to six, vertical printed pages, and in particular to newspaper pages.

In contrast to printing presses with double circumference and single width, the embodiment of the cylinders 02, 03, 07, 11 with double width and—at least the forme cylinders 02, 11—with a "single circumference" makes a considerably greater product variability possible. Although the maximum number of possible printed pages remains the same, in the case of single-width printing groups 01, 12 with double circumference they are in two different "books", or "booklets" in the assembly operation. In the present case, with double-width printing groups 01, 12 of single circumference, the double-width webs 08 are longitudinally cut after having been imprinted. In order to achieve a maximum booklet width, one or several partial webs are conducted one above the other to the so-called folding superstructure, or turning deck, and are folded to form a booklet on a former without assembly operations. If such booklet thicknesses are not required, some partial webs can be guided on top of each other, but others can be conducted together to a second former and/or folding apparatus. However, two products of identical thickness can also be conducted without being transferred to two folding apparatus. A variable thickness of two different products is thus provided. If, in case of a double folding apparatus or of two folding apparatus, in which at least two product delivery devices are provided, it is possible, depending on the arrangement, to conduct the two booklets, or products, next to or above each other to one side of the printing press, or to two different sides.

The double-width printing press of single circumference has a great variability, in particular when staggering the possible page numbers of the product, the co-called "page jump". While the thickness per booklet, or layer in the printing press of double circumference and of single width can only be varied in steps of four printed pages during assembly operation, i.e. with maximum product thickness, the described double-width printing press of single circumference allows a "page jump" of two pages, for example when printing newspapers. The product thickness, and in particular the "distribution" of the printed pages to different books of the total product or the products, is considerably more flexible.

After the web 08 has been longitudinally cut, the partial web is conducted either to a former and/or folding apparatus which is different in respect to the corresponding partial web, or is turned to be aligned with the last mentioned one. This means that, in the second case, the partial web is brought into the correct longitudinal, or cutting register prior to, during or after turning, but before being brought together with the "straight ahead webs". In an advantageous embodiment, this is taken into account as a function of the circumferential direction of grooves 04, 06, which are offset in respect to each other, of a cylinder 02, 03, 07, 11 by the appropriate design of the turning deck for example preset distances of the bars, or of the track sections. Fine adjustment, or correction, is performed by use of the setting tracks of the cutting register control device of the affected partial web and/or partial web strand, in order to place partial webs on two different running levels on top of each other with the correct registration, when required.

Figure 13:
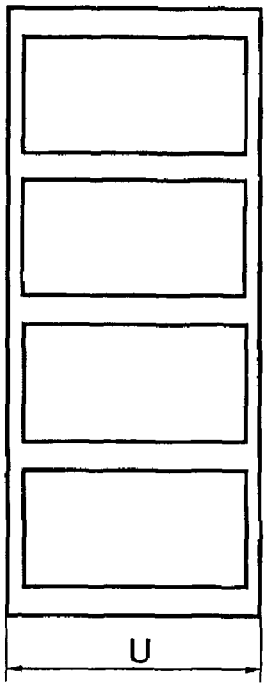
Figure 14:
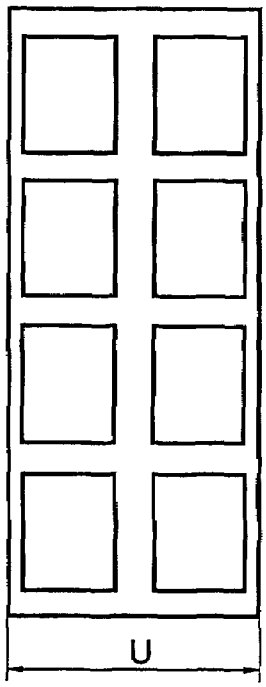
Figure 15:
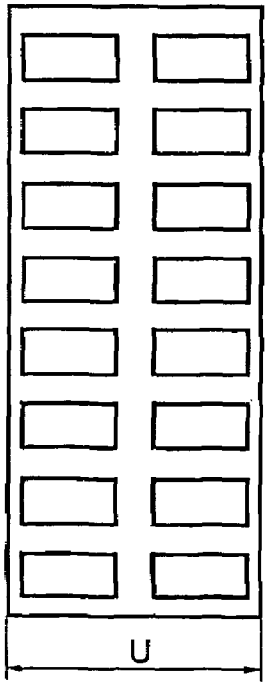
Figure 16:
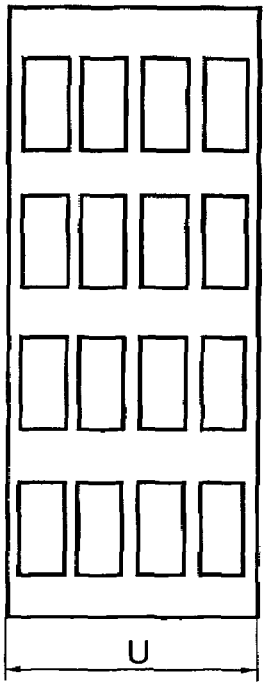

Now, the forme cylinders 02, 11 can be provided, in the circumferential direction, with one vertical printed page in broadsheet format and, in the longitudinal direction, with at least four, as seen in FIG. 13. Alternatively, these forme cylinders 02, 11 can also be selectively provided with two pages in the circumferential direction and, in the longitudinal direction, with at least four horizontal printed pages in tabloid format, as seen in FIG. 14, or with two pages in the circumferential direction and, in the longitudinal direction, with at least eight vertical printed pages in book format, as seen in FIG. 15, or with four pages in the circumferential direction and in the longitudinal direction with at least four horizontal printed pages in book format, as seen in FIG. 16 by the use of respectively one flexible printing plate which can be arranged in the circumferential direction of the forme cylinder 03, and at least one flexible printing plate arranged in its longitudinal direction.

Thus, depending on the coverage of the forme cylinders 02, 11 with horizontal tabloid pages, or with vertical newspaper pages, and in particular with broadsheet pages, or with horizontal or vertical book pages, it is possible by use of the double-width printing press and at least the forme cylinders 02, 11 of single circumference, to produce different products, depending on the width of the web 08 used.

With the double printing group 13, the production, in one stage, of two vertical printed pages arranged on the forme cylinder, a "two page jump" with variable products in broadsheet format, is possible.

With a width of the web 08 corresponding to four, or to three, or to two vertical printed pages, or of one vertical printed page in broadsheet format, the production of a product in broadsheet format consisting of a layer in the above sequence with eight, or six, or four, or two printed pages is possible.

With a web width corresponding to four vertical printed pages in broadsheet format, the double printing group can be used for producing respectively two products in broadsheet format, consisting of one layer with four printed pages in the one product and four printed pages in the other product, or with two printed pages in the one product and with six printed pages in the other product. With a web width corresponding to three vertical printed pages, it is suitable for producing respectively two products in broadsheet format consisting of one layer with four printed pages in the one product and with two printed pages in the other product.

Furthermore, with a web width corresponding to four vertical printed pages in broadsheet format, the double printing group 13 can be used for the production of a product in broadsheet format consisting of two layers with four printed pages in the one layer and with four printed pages in the other layer, or with two printed pages in the one layer and with six printed pages in the other layer. With a web width corresponding to three vertical printed pages, the double printing group 13 can be used for producing a product in broadsheet format consisting of two layers with four printed pages in the one layer and two printed pages in the other layer.

In the case of printed pages in tabloid format, the double printing group 13 can be used for producing in one stage printed pages arranged horizontally on the forme cylinder 02, 11 with variable products, a "four page jump" in tabloid format. Accordingly, with a web width corresponding to four, or to three, or to two horizontal printed pages, or to one horizontal printed page, the double printing group 13 can be used for producing a product in tabloid form consisting of one layer in the above sequence with sixteen, or twelve, or eight, or four printed pages.

With a web width corresponding to four horizontal printed pages in tabloid form, the double printing group 13 can be used for producing two products in tabloid format, each consisting of one layer with eight printed pages in the one product and with eight printed pages in the other product, or with four printed pages in the one product and with twelve printed pages in the other product. With a web width corresponding to three horizontal printed pages, the double printing group 13 can be used for producing two products in tabloid format, each consisting of one layer with four printed pages in the one product and with eight printed pages in the other product.

With products in book format, the double printing group 13 can be used for producing, in one stage, eight printed pages with variable, "eight page jump" products arranged vertically on the printing cylinders 02, 11.

With a web width corresponding to eight, or to six, or to four, or to two vertical printed pages, the production of a product in book format consisting of a layer in the above sequence with thirty-two, or twenty-four, or sixteen, or eight printed pages, is possible by means of the double printing group 13.

With a web width corresponding to eight vertical printed pages in book format, the double printing group 13 can be used for producing respectively two products in book format, each consisting of one layer, with sixteen printed pages in the one product and with sixteen printed pages in the other product, or with twenty-four printed pages in the one product and with eight printed pages in the other product. With a web width corresponding to six vertical printed pages in book format, the double printing group 13 can be used for producing respectively two products in book format, each consisting of one layer, with sixteen printed pages in the one product and with eight printed pages in the other product.

For products in book format, the double printing group 13 is furthermore usable for producing, in one stage, eight printed pages arranged vertically with variable products, "eight page jump" on the forme cylinder 03 (double transverse fold).

With a web width corresponding to four, or to three, or to two horizontal printed products, or to one horizontal printed page in book format, the double printing group 13 can be used for producing a product in book format consisting of a layer in the above sequence with thirty-two, or with twenty-four, or with sixteen, or with eight printed pages.

With a web width corresponding to four horizontal printed pages in book format, the double printing group 13 can be used for producing respectively two products in book format, each consisting of a layer, with sixteen printed pages in the one product and with sixteen printed pages in the other product, or with twenty-four printed pages in the one product and with eight printed pages in the other product. With a web width corresponding to three horizontal printed pages in book format, the double printing group 13 can be used for producing respectively two products in book format, each consisting of a layer, with sixteen printed pages in the one product and with eight printed pages in the other product.

If the two partial web strands are longitudinally folded on different formers and thereafter conducted to a common folding apparatus, what was said above should be applied to the distribution of the products to different folded booklets, or layers, of the described variable number of pages.

While preferred embodiments of a printing couple in a printing machine with a pivotable transfer cylinder, in accordance with the present invention, have been set forth fully and completely hereinabove, it will be apparent to one of skill in the art that various changes in, for example the type of web being printed, the specific structure of the blankets or dressings secured to the cylinders, and the like could be made without departing from the true spirit and scope of the present invention which is accordingly to be limited only by the following claims.

The invention claimed is:

1. A printing group of a printing press comprising:

a first forme cylinder having a first forme cylinder axis of rotation;

a first transfer cylinder having a first transfer cylinder axis of rotation and being engageable with said first forme cylinder;

a second transfer cylinder having a second transfer cylinder axis of rotation and being engageable with said first transfer cylinder in a print-on position, a web to be printed having a web first side engaged by said first transfer cylinder and a web second side engaged by said second transfer cylinder in said print-on position;

a second forme cylinder having a second forme cylinder axis of rotation and being engageable with said second transfer cylinder;

a common plane defined by said axes of rotation of said first and second forme cylinders and said first and second transfer cylinders in said print-on position;

a first lever having a first end supporting said first transfer cylinder for rotation about said first transfer cylinder axis of rotation and having a second end pivotable about a first lever pivot axis, said first lever pivot axis being located on said web first side of said printing group;

a first setting means contacting said first lever to pivot said first lever about said first lever pivot axis, said first setting means being usable to selectively place said first transfer cylinder into and out of contact with said first forme cylinder and said second transfer cylinder;

a first lever length between said axis of rotation of said first transfer cylinder and said first lever pivot axis;

a first spacing distance between said first forme cylinder axis of rotation and said first transfer cylinder axis of rotation in said print-on position, said first lever length being greater than said first spacing distance;

a second lever having a first end supporting said second transfer cylinder for rotation about said second transfer cylinder axis of rotation, and a second end pivotable about a second lever pivot axis, said second lever pivot axis being located on said web second side of said printing group;

a second setting means contacting said second lever to pivot said second lever about said second lever pivot axis, said second setting means being usable to selectively place said second transfer cylinder into and out of contact with said second forme cylinder and said first transfer cylinder;

a second lever length between said axis of rotation of said second transfer cylinder and said second lever pivot axis; and a second spacing distance between said second forme cylinder axis of rotation and said second transfer cylinder axis of rotation in said print-on position, said second lever length being greater than said second spacing distance, said first lever pivot axis being located on a first side of said common plane, said second lever pivot axis being located on a second side of said common plane which is opposite from said first side of said common plane.

2. The printing group of claim 1 further including a connecting plane passing through said first forme cylinder axis of rotation and said first lever pivot axis, said connecting plane intersecting said common plane at an angle of between 25° and 65°.

3. The printing group of claim 1 wherein said axis of rotation of at least said first forme cylinder is fixed.

4. The printing group of claim 1 further including a first forme cylinder adjusting means for said first forme cylinder and usable to vary a distance between said first forme cylinder axis of rotation and said first transfer cylinder axis of rotation.

5. The printing group of claim 4 wherein said first forme cylinder adjusting means has a first adjusting means pivot axis which is coincident with said first lever pivot axis.

6. The printing group of claim 4 further including a first transfer cylinder adjusting means for said first transfer cylinder and usable to vary a distance between said first transfer cylinder and said second transfer cylinder.

7. The printing group of claim 4 wherein said first forme cylinder adjusting means is operable to move said first forme cylinder in a direction perpendicular to said first forme cylinder axis of rotation.

8. The printing group of claim 7 wherein said first forme cylinder adjusting means is an eccentric bushing seated in a lateral frame of said printing group and supporting said first forme cylinder, said first forme cylinder eccentric bushing having a pivot axis.

9. The printing group of claim 8 further including a connecting plane through said first forme cylinder axis of rotation and said first forme cylinder eccentric bushing pivot axis, said connecting plane intersecting said common plane at an angle of between 25° and 65°.

10. The printing group of claim 1 further including a first transfer cylinder adjusting means for said first transfer cylinder and usable to vary a distance between said first transfer cylinder and said second transfer cylinder.

11. The printing group of claim 10 further including a first transfer cylinder adjusting means axis of rotation and wherein a connecting plane between said first transfer cylinder axis of rotation and said first transfer cylinder adjusting means axis of rotation intersects said common plane at an angle of between 70° and 110°.

12. The printing group of claim 10 wherein said first transfer cylinder adjusting means is usable to move said first transfer cylinder in a direction perpendicular to said first transfer cylinder axis of rotation.

13. The printing group of claim 12 wherein said first transfer cylinder adjusting means is an eccentric bushing supported in said first end of said first lever.

14. The printing group of claim 13 wherein said first transfer cylinder eccentric bushing has a pivot axis and wherein a plane passing through said first transfer cylinder eccentric bushing pivot axis and said first transfer cylinder axis of rotation intersects said common plane at an angle of between 70° and 110°.

15. The printing group of claim 1 further including a separate drive motor for each of said first and second forme cylinders and transfer cylinders.

16. The printing group of claim 15 further including a frame supporting said printing group and wherein said drive motor for each said first and second forme cylinder is fixed on said frame.

17. The printing group of claim 15 further including a frame supporting said printing group and wherein said drive motor for each said first and second transfer cylinder is fixed on said frame.

18. The printing group of claim 17 further including a coupling adapted to compensate for angle and offset displacement situated between each said drive motor and each said transfer cylinder.

19. The printing group of claim 15 further including a driving connection between each said forme cylinder and each said associated drive motor, said driving connection being adapted to absorb relative movement between the two.

20. The printing group of claim 1 further including a first common drive motor for said first forme cylinder and said first transfer cylinder and a second common drive motor for said second forme cylinder and said second transfer cylinder.

21. The printing group of claim 20 further including a frame supporting said printing group and wherein said drive motor for each said first and second forme cylinder is fixed on said frame.

22. The printing group of claim 20 further including a frame supporting said printing group and wherein said drive motor for each said first and second transfer cylinder is fixed on said frame.

23. The printing group of claim 22 further including a coupling adapted to compensate for angle and offset displacement situated between each said drive motor and each said transfer cylinder.

24. The printing group of claim 1 wherein said first lever pivot axis is supported for movement eccentrically with respect to said first forme cylinder axis of rotation.

25. The printing group of claim 24 wherein an eccentricity of said first lever pivot axis is between 7 mm and 15 mm.

26. The printing group of claim 1 wherein said first lever pivot axis is arranged stationarily with respect to a lateral frame of said printing press.

27. The printing group of claim 1 wherein said common plane is inclined at an angle of between 75° and 85° with respect to a plane of said web passing through said printing group.

28. The printing group of claim 1 wherein said axis of rotation of said first forme cylinder is fixed during said engagement of said first transfer cylinder with said first forme cylinder.

29. The printing group of claim 1 wherein each of said first and second forme cylinders and each of said first and second transfer cylinders includes at least a first axially extending surface interruption, said forme cylinder surface interruption rolling off on said transfer cylinder surface interruption.

30. The printing press of claim 29 wherein each said first and second transfer cylinder has a circumference equal to a whole number multiple, greater than one, of said forme cylinder circumference.

31. The printing group of claim 29 further including at least a second surface interruption on each of said first and second forme cylinders and each of said first and second transfer cylinders, said first and second surface interruptions on each of said cylinders being arranged axially adjacent and circumferentially offset.

32. The printing group of claim 29 wherein said first and second surface interruptions on said first and second forme cylinders are arranged to roll off in pairs against said first and second surface interruptions on said first and second transfer cylinders.

33. The printing group of claim 1 wherein each said first and second forme cylinders has a circumference corresponding to a length of a printed page in newspaper format.

34. The printing group of claim 1 wherein each of said first and second forme cylinders and each of said first and second transfer cylinders has an axial length of four widths of a newspaper page.

* * * * *